US009521490B2

(12) United States Patent
Kawata et al.

(10) Patent No.: US 9,521,490 B2
(45) Date of Patent: Dec. 13, 2016

(54) SPEAKER DIAPHRAGM AND PRODUCTION METHOD FOR SPEAKER DIAPHRAGM

(71) Applicants: Pioneer Corporation, Kanagawa (JP); Tohoku Pioneer Corporation, Yamagata (JP); Mogami Denki Corporation, Yamagata (JP)

(72) Inventors: Kazuharu Kawata, Yamagata (JP); Yoshihiro Sato, Yamagata (JP); Hideki Takahashi, Yamagata (JP)

(73) Assignees: Pioneer Corporation, Kanagawa (JP); Tohoku Pioneer Corporation, Yamagata (JP); Mogami Denki Corporation, Yamagata (JP)

( * ) Notice: Subject to any disclaimer, the term of this patent is extended or adjusted under 35 U.S.C. 154(b) by 0 days.

(21) Appl. No.: 14/384,956

(22) PCT Filed: Mar. 13, 2013

(86) PCT No.: PCT/JP2013/057103

§ 371 (c)(1),
(2) Date: Sep. 12, 2014

(87) PCT Pub. No.: WO2013/137362

PCT Pub. Date: Sep. 19, 2013

(65) Prior Publication Data

US 2015/0010197 A1 Jan. 8, 2015

(30) Foreign Application Priority Data

Mar. 14, 2012 (WO) ..... PCT/JP2012/056527

(51) Int. Cl.
*H04R 1/00* (2006.01)
*H04R 7/04* (2006.01)
(Continued)

(52) U.S. Cl.
CPC ..... *H04R 7/04* (2013.01); *H04R 7/125* (2013.01); *H04R 9/025* (2013.01); *H04R 31/003* (2013.01);
(Continued)

(58) Field of Classification Search
CPC ..... H04R 7/02; H04R 7/125; H04R 2307/029; H04R 9/025; H04R 2307/021; H04R 7/122; H04R 2307/025; D21H 15/12
See application file for complete search history.

(56) References Cited

U.S. PATENT DOCUMENTS 3,717,218 A * 2/1973 Shiga ..... H04R 7/20 181/167
4,308,094 A * 12/1981 Miyoshi ..... D21J 3/12 162/135
(Continued)

FOREIGN PATENT DOCUMENTS

JP 47-041617 A 12/1972
JP 48-57615 A 8/1973
(Continued)

OTHER PUBLICATIONS

Uslu et al., "Preparation and Characterization of PVA/Boron Polymer Produced by an Electrospinning Technique", Nov. 8, 2007, European Polymer Federation: e-Polymers, No. 133.*
(Continued)

*Primary Examiner* — Quoc D Tran
*Assistant Examiner* — Ryan Robinson
(74) *Attorney, Agent, or Firm* — Osha Liang LLP

(57) ABSTRACT

A diaphragm can be obtained which exhibits large internal loss and Young's modulus and which can be produced efficiently. A speaker diaphragm 1 comprises at least one layer 1A formed by molding a component member config-
(Continued)

ured by a fiber and a tangled fiber body of a synthetic fiber. The synthetic fiber is a polyvinyl alcohol fiber having boron.

8 Claims, 10 Drawing Sheets

(51) Int. Cl.

| | |
|---|---|
| ***H04R 7/12*** | (2006.01) |
| ***H04R 31/00*** | (2006.01) |
| ***H04R 9/02*** | (2006.01) |
| *D21H 13/16* | (2006.01) |

(52) U.S. Cl.
CPC ..... *D21H 13/16* (2013.01); *H04R 2307/025* (2013.01); *H04R 2307/029* (2013.01)

(56) References Cited

U.S. PATENT DOCUMENTS

| | | | | |
|---|---|---|---|---|
| 4,428,996 | A | 1/1984 | Miyoshi et al. | |
| 5,110,678 | A * | 5/1992 | Narukawa | D01F 6/14 264/147 |
| 5,206,466 | A * | 4/1993 | Inamiya | B32B 5/08 181/169 |
| 5,473,121 | A * | 12/1995 | Uryu | H04R 7/125 181/169 |
| 7,283,642 | B2 * | 10/2007 | Milot | H04R 9/025 381/400 |
| 7,677,356 | B2 * | 3/2010 | Yang | D04H 1/435 181/167 |
| 7,708,111 | B2 * | 5/2010 | Uryu | H04R 7/12 181/167 |
| 8,824,725 | B2 * | 9/2014 | Funahashi | H04R 7/125 181/169 |
| 2005/0051380 | A1 * | 3/2005 | Takayama | B32B 27/36 181/170 |
| 2007/0017737 | A1 | 1/2007 | Uryu et al. | |

FOREIGN PATENT DOCUMENTS

| | | | |
|---|---|---|---|
| JP | 53-096822 | A | 8/1978 |
| JP | 54-114233 | A | 9/1979 |
| JP | 57-022158 | A | 2/1982 |
| JP | 01-104815 | A | 4/1989 |
| JP | 10-013988 | A | 1/1998 |
| JP | 2007-028525 | A | 2/2007 |
| JP | 2011-146769 | A | 7/2011 |

OTHER PUBLICATIONS

International Search Report issued in PCT/JP2013/057103 mailed on May 21, 2013 (4 pages).

* cited by examiner

ENLARGED VIEW OF A PART

SPEAKER DIAPHRAGM AND PRODUCTION METHOD FOR SPEAKER DIAPHRAGM

TECHNICAL FIELD

Embodiments of the invention relate to a speaker diaphragm and a production method for the speaker diaphragm.

BACKGROUND

As a constituent material of a speaker diaphragm, various materials such as a paper material, a polymer (resin) material, a metal material, a ceramic material, and a composite material are used. There are also known diaphragms configured by paper made of a natural fiber or non-woven fabric made of a synthetic fiber. Among the diaphragms, a paper diaphragm made of the natural fiber generally exhibits advantages, as represented by low density, large internal loss, and easy manufacturing thereof. Therefore, paper diaphragms have been widely used.

As a conventional technique in a production method for a paper diaphragm, there is known a technique including a paper making process for subjecting a diaphragm material to paper making, a preliminary drying process for drying the material subjected to the paper making to vaporize moisture, and a press-molding process for press-molding a preliminary molded product obtained by the preliminary drying process (see, for example, Patent literatures 1 and 2 described below).

RELATED ART DOCUMENT

Patent Literature

[Patent literature 1] Japanese Patent Application Laid-open No. 2011-146769

[Patent literature 2] Japanese Patent Application Laid-open No. S48-57615

SUMMARY

Physical properties required of a speaker diaphragm reside in an increase in an internal loss and an increase in a Young's modulus or a specific elastic modulus (E/ρ; E represents a Young's modulus of a diaphragm material and ρ represents a density of the diaphragm material). In general, the speaker diaphragm has a tendency that, if the internal loss is increased, the Young's modulus decreases and, if the Young's modulus is increased, the internal loss decreases. As explained above, the paper speaker diaphragm made of the natural fiber generally has a large internal loss and a low density but the Young's modulus tends to be small. On the other hand, in some case, the Young's modulus of the paper diaphragm is improved by mixing a filler such as mica with the natural fiber.

When the filler such as mica is mixed in the fiber, in some case, a fiber as a binder configured by water-soluble polyvinyl alcohol, which dissolves in hot water, is further mixed in the natural fiber. However, since the fiber configured by the polyvinyl alcohol is water-soluble, the fiber configured by the polyvinyl alcohol attaches to a mesh used in the paper making process and a die used in the molding process and is less easily peeled from the mesh and the die. There is a problem in that handleability in the paper making process and the molding process decreases and satisfactory productivity is not obtained.

As described in Patent literature 2, it is also conceivable to stick together layers formed in separate processes. However, in this case, an adhesive which increases the weight of a diaphragm is necessary. When the layers are stuck together without using the adhesive, there is a problem in that peeling tends to occur.

The present invention has an example of an object in dealing with such problems. That is, it is an object of the present invention to, for example, obtain a speaker diaphragm having a relatively high internal loss and a relatively high Young's modulus and provide a speaker diaphragm and a manufacturing method for the speaker diaphragm with which high productivity is obtained.

In order to attain such an object, a speaker diaphragm and a production method for the speaker diaphragm of the present invention include characteristics explained below.

A speaker diaphragm comprising at least one layer, wherein the layer is configured by a component member, which is a tangled fiber body, the tangled fiber body is configured by a fiber and a synthetic fiber different from the fiber, and the synthetic fiber is a polyvinyl alcohol fiber having boron.

A production method for a speaker diaphragm, the speaker diaphragm comprising at least one layer, the production method including a molding process for molding the one layer into a specified shape, wherein a component member of the one layer is configured by a tangled fiber body, the tangled fiber body is configured by a fiber and a synthetic fiber different from the fiber, and the synthetic fiber is a polyvinyl alcohol fiber having boron.

DETAILED DESCRIPTION

Figure 1:
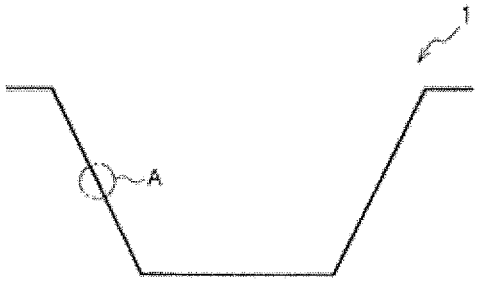
FIG. 1 is an explanatory diagram showing the structure of a speaker diaphragm according to an embodiment of the present invention (FIG. 1(*a*) is an overall schematic diagram of a cross section and FIG. 1(*b*) is an A part enlarged view of the cross section).
Figure 1:
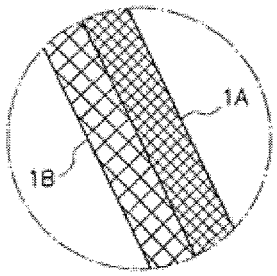

An embodiment of the present invention is explained below. A speaker diaphragm according to the embodiment of the present invention comprises at least one layer formed by molding into a specified shape a component member made of a tangled fiber body configured by a fiber and a synthetic fiber different from the fiber. The synthetic fiber used here is, for example, a polyvinyl alcohol fiber having boron. As an example of the polyvinyl alcohol fiber having the boron, the polyvinyl alcohol fiber can be configured by polyvinyl alcohol resin having boron or polyvinyl alcohol resin having boron bridging. Examples of a molecular structure of the polyvinyl alcohol having boron are indicated by the following formulas.

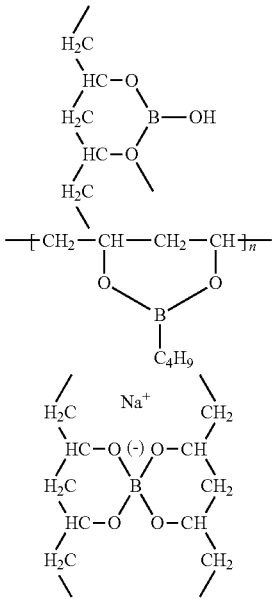

The polyvinyl alcohol resin having the boron bridging is, for example, resin in which a bridging structure by boron is formed by adding boric acid, borate, boronic acid, or the like to polyvinyl alcohol. The polyvinyl alcohol is a polymer containing 10 mol % or more, preferably 30 mol % or more, and more preferably 50 mol % or more of a vinyl alcohol unit. Usually, the polyvinyl alcohol is obtained by hydrolyzing (saponification, alcoholysis, etc.) a homopolymer or a copolymer of vinyl ester or vinyl ether. Representative examples of the vinyl ester include vinyl acetate. Other examples of the vinyl ester include formic acid vinyl, propionic acid vinyl, pivalic acid vinyl, valeic acid vinyl, capric acid vinyl, and benzonic acid vinyl. Examples of the vinyl ether include t-butyl vinyl ether and benzyl vinyl ether. The polyvinyl alcohol may include monomer units described below. Examples of the monomer units include: olefins such as propylene excluding ethylene, 1-butene, and isobutene; unsaturated acids such as acrylic acid, methacrylic acid, maleic acid, itaconic acid, and maleic anhydride, or salts thereof, or mono or dialkyl esters having a carbon number of 1 to 18; acrylamides such as acrylamide, N-alkylacrylamide having a carbon number of 1 to 18, N, N-dimethylacrylamide, and 2-acrylamide propanesulfonic acid, or salt acids thereof, or quaternary salts thereof; methacrylamides such as methacrylamide, N-alkylmethacrylamide having a carbon number of 1 to 18, N, N-dimethylmethacrylamide, and 2-methacrylamide propanesulfonic acid or salts thereof, and methacrylamide propyl dimethylamine or acid salt thereof or quarternary salt thereof; N-vinylamides such as N-vinylpyrrolidone, N-vinylformamide, and N-vinylacetamide; allylic compounds such as allyl acetate, allyl alcohol, and 8-hydroxy-1-octene; vinyl cyanides such as acrylonitrile and methacrylonitrile; vinyl ethers such as alkyl vinyl ether having a carbon number of 1 to 18 and alkoxyalkyl vinyl ether; vinyl halides such as vinyl chloride, vinylidene chloride, vinyl fluoride such as vinylidene fluoride; dimethyl allyl alcohol, and vinyl ketone.

In the speaker diaphragm according to the embodiment of the present invention, physical properties (an internal loss and a Young's modulus) of the diaphragm can be improved with good balance by molding a component member made of a tangled fiber body configured by a fiber and a polyvinyl alcohol fiber having boron. Handling in the paper making process is facilitated and releasability in the molding process is improved by using the polyvinyl alcohol fiber having the boron having insolubility to water. Therefore, it is possible to obtain satisfactory productivity.

In the paper making process, for example, the component member is easily removed from the mesh used for the paper making. In the molding process, for example, the component member is easily removed from the die. The present invention can be applied to a polyvinyl alcohol fiber having insolubility to water and hot water exceeding 80° C. other than the polyvinyl alcohol fiber having the boron. Examples of the polyvinyl alcohol fiber include a polyvinyl alcohol fiber having a bridging structure with a relatively large molecular weight. Note that, in the following explanation, the embodiment is explained in which the polyvinyl alcohol fiber having the boron is used. However, embodiments are not limited to this. It is considered that an embodiment is also provided in which the polyvinyl alcohol fiber is replaced with the polyvinyl alcohol fiber having insolubility to water and hot water exceeding 80° C.

The speaker diaphragm according to the embodiment of the present invention comprises, for example, a first layer and a second layer. The first layer and the second layer are respectively configured by molding a first component member and a second component member of the tangled fiber body into a specified shape. The tangled fiber body of the first component member is configured by a fiber and a synthetic fiber different from the fiber. The tangled fiber body of the second component member is configured by a fiber. The synthetic fiber is configured by a polyvinyl alcohol fiber having boron. Since the speaker diaphragm has such a configuration, as explained above, it is possible to improve the physical properties (the internal loss and the Young's modulus) of the speaker diaphragm with good balance and obtain high productivity. Since the speaker diaphragm has the polyvinyl alcohol fiber having the boron, it is possible to increase a joining force or an adhesive force of the first layer and the second layer. The fiber in the first component member and the fiber in the second component member may be substantially the same fibers or may be different fibers.

In the speaker diaphragm according to the embodiment of the present invention, for example, the synthetic fiber has a bending shape (including a curved shape). Since the synthetic fiber has the bending shape, the synthetic fiber is easily tangled with the fiber. This makes it possible to improve the Young's modulus of the speaker diaphragm. When the speaker diaphragm has a multilayer structure, since the synthetic fiber has the shape explained above, it is possible to increase the joining force or the adhesive force of the first layer and the second layer.

In the speaker diaphragm according to the embodiment of the present invention, a cross sectional shape of the synthetic fiber is a circular shape.

Consequently, a crack less easily occurs in the fiber and this makes it possible to maintain the physical properties of the speaker diaphragm for a long period.

In the speaker diaphragm according to the embodiment of the present invention, for example, the fiber is a natural fiber. The fiber may be other fibers explained below other than the natural fiber. The speaker diaphragm having the natural fiber has a relatively large internal loss. One layer or the first layer of the speaker diaphragm according to the embodiment of the present invention has, for example, mica. Since the polyvinyl alcohol fiber having the boron is used as the synthetic fiber, the mica attaches to the synthetic fiber. It is possible to prevent the mica from falling off the speaker diaphragm. Since the speaker diaphragm has the mica, it is possible to improve the Young's modulus of the speaker diaphragm. Satisfactory glossiness appears on the surface of the speaker diaphragm having the mica. It is possible to obtain satisfactory design properties. When the speaker diaphragm has the multilayer structure, since the first layer has the mica, it is possible to improve the Young's modulus of the speaker diaphragm. When the first layer having the mica is a surface layer, it is possible to improve the design properties of the speaker diaphragm. Even if not all the layers have the mica, it is possible to improve the Young's modulus and improve the design properties. Therefore, it is possible to reduce an amount of use of the mica and reduce total weight and costs of the speaker diaphragm. In this case, for example, only the first layer, which is substantially the surface layer, may have the mica.

When the speaker diaphragm according to the embodiment of the present invention has the multilayer structure, for example, the second layer may be substantially configured by only the fiber. Since the second layer is configured by the fiber, it is possible to adjust the internal loss and the Young's modulus of the speaker diaphragm. The weight of the synthetic fiber (the polyvinyl alcohol fiber having the boron) may be set low with respect to the weight of the fiber. By adding an appropriate amount of the polyvinyl alcohol fiber having the boron to another fiber (e.g., the natural fiber) to configure the component member, it is possible to adjust the Young's modulus and the internal loss of the speaker diaphragm. By configuring the second layer with the fiber and configuring the first layer with the mica, the fiber, and the synthetic fiber, it is possible to reduce an amount of use of the mica or an amount of use of the synthetic fiber. Note that the second layer may be configured by the fiber and the synthetic fiber and is not particularly limited.

In the speaker diaphragm according to the embodiment of the present invention, the internal loss and the Young's modulus thereof are large with respect to an internal loss and a Young's modulus of a reference diaphragm having only a single layer configured by the tangled fiber body substantially configured by the fiber (e.g., the natural fiber). In the speaker diaphragm according to the embodiment of the present invention, the internal loss and the Young's modulus thereof are large with respect to a reference diaphragm having only a single layer configured by the tangled fiber body of the second layer. That is, in the speaker diaphragm according to the embodiment of the present invention, in the case of the single layer, for example, the internal loss is larger than 0.0216 and the Young's modulus is larger than $4.40*10^9$ ($N/mm^2$). In the speaker diaphragm according to the embodiment of the present invention, in the case of the multiple layers, for example, the internal loss is larger than 0.0239 and the Young's modulus is larger than $3.5*10^9$ ($N/mm^2$).

In a production method for the speaker diaphragm according to the embodiment of the present invention, the speaker diaphragm comprises at least one layer. The production method includes a process for forming a component member configuring the one layer and a molding process for molding the component member into a specified shape. According to necessity, the process for forming the component member may be omitted. The component member procured from the outside may be molded into the specified shape in the molding process. In this case, the production method for the speaker diaphragm includes at least the molding process. The component member configuring the one layer is configured by a tangled fiber body. The tangled fiber body of the component member is configured by a fiber and a synthetic fiber different from the fiber. The synthetic fiber is a polyvinyl alcohol fiber having boron. More specifically, the synthetic fiber is configured by polyvinyl alcohol resin having boron.

In the production method for the speaker diaphragm, the speaker diaphragm comprises a first layer and the second layer. The production method includes a superimposing process for superimposing a first component member configuring the first layer and a second component member configuring the second layer and a molding process. In the molding process, the first component member and the second component member superimposed in the superimposing process are molded into a specified shape. The second component member is configured by a tangled fiber body. The tangled fiber body of the second component member is configured by a fiber. The second component member may include a synthetic fiber. The production method for the speaker diaphragm includes a process of forming the first component member configuring the first layer and a process of forming the second component member configuring the second layer.

The process of forming the first component member and the process of forming the second component member may be performed in parallel. By simultaneously promoting the process of forming the first component member and the process of forming the second component member, it is possible to reduce a cycle time of a production process and improve productivity.

In the process of forming the first component member, paper making is performed with a first mesh arranged in a first tank in which a suspension dispersed with, for example, a fiber, which is a natural fiber, and a synthetic fiber is injected. Consequently, the first component member is deposited on the first mesh. In the process of forming the second component member, paper making is performed with the first mesh or a second mesh arranged in a second tank in which a suspension dispersed with, for example, a fiber, which is a natural fiber, is injected. When the first mesh is arranged in the second tank, the second component member is deposited on the first component member deposited on the first mesh. When the second mesh is arranged in the second tank, the second component member is deposited on the second mesh. Note that the synthetic fiber may be included in the fiber other than the natural fiber.

In the production method for the speaker diaphragm according to the embodiment of the present invention, in the superimposing process, the first component member attached to the first mesh and the second component member attached to the second mesh are superimposed. The first component member and the second component member may be superimposed in the first tank or the second tank. When the first component member and the second component member are superimposed, a bottom surface section of one mesh of the first mesh and the second mesh is arranged on a bottom surface section side of the tank with respect to an outer circumference section of the one mesh. A bottom surface section of the other mesh is arranged on the bottom surface section of the tank with respect to an outer circumference section of the other mesh. In the superimposing process, since the first component member and the second component member are superimposed between the first mesh and the second mesh, it is possible to closely attach the first component member and the second component member in the superimposing process.

In the production method for the speaker diaphragm according to the embodiment of the present invention, in the molding process, the superimposed first component member and second component member are held by a first die and a second die. The first component member and the second component member are heated via the first die or the second die. The first die has, for example, a concave cross sectional shape as a shape corresponding to the shape of the diaphragm. The second die has a cross sectional shape corresponding to the cross sectional shape of the first die. The temperature of the first die and the second die may be set to temperature equal to or higher than 100° C. A dissolving temperature in water of the synthetic fiber is higher than 80° C. In the molding process, when an ambient temperature rises to temperature equal to or higher than 100° C., the polyvinyl alcohol fiber (the synthetic fiber) having insolubility to water or hot water may be dissolved to bond the plurality of fibers one another or form the fibers as a film.

The first die is arranged on the second component member side. The second die is arranged on the first component member side. The first mesh may be arranged between the second die and the first component member. The second die may have a hole section that allows a space present between the second die and the first component member and the outside to communicate with each other. Since the second die has the hole section, it is possible to discharge water vapor in the space present between the second die and the first component member to the outside. According to the discharge of the water vapor, it is possible to reduce an internal pressure in the space between the second die and the first component member. Since the internal pressure is reduced, it is possible to prevent a situation in which the speaker diaphragm is broken because the air compressed by the rise of the internal pressure suddenly leaks to the outside from a gap between the second die and the first die.

The second mesh may be arranged between the first die and the second component member. The first die may have a hole section that allows a space present between the first die and the second component member and the outside to communicate with each other. Since the first die has the hole section, it is possible to discharge water vapor in the space present between the first die and the second component member to the outside. According to the discharge of the water vapor, it is possible to reduce an internal pressure in the space present between the first die and the second component member. Since the internal pressure is reduced, it is possible to prevent a situation in which the speaker diaphragm is broken because the air compressed by the rise of the internal pressure suddenly leaks to the outside from a gap between the first die and the second die.

In the production method for the speaker diaphragm according to the embodiment of the present invention, the synthetic fiber mixed in the fiber, which is the natural fiber, is the polyvinyl alcohol fiber having the boron. Therefore, it is possible to obtain high releasability even if the component members are molded at high temperature equal to or higher than 100° C., The embodiment of the present invention is explained more specifically with reference to the drawings. FIG. 1 is an explanatory diagram showing the structure of the speaker diaphragm according to the embodiment of the present invention (FIG. 1(*a*) is an overall schematic diagram of a cross section and FIG. 1(*b*) is an A part enlarged view of the cross section). A speaker diaphragm 1 according to the embodiment of the present invention is formed in, for example, a cone shape as shown in FIG. 1(*a*) and comprises a first layer (a front layer) 1A and a second layer (a rear layer) 1B as shown in FIG. 1(*b*). In the following explanation, an example of a two-layer structure is explained. However, the speaker diaphragm according to the embodiment of the present invention may comprise a single layer structure having a synthetic fiber or may comprise a multilayer structure of three or more layers including a layer having the synthetic fiber. A natural fiber is described as an example of the fiber.

The first layer 1A and the second layer 1B are formed by superimposing a first component member and a second component member, both of which are configured by tangled fiber bodies, and, for example, applying molding to the component members at a time. A first component member corresponding to the first layer 1A is a component member obtained by mixing the natural fiber and the synthetic fiber and subjecting the natural fiber and the synthetic fiber to paper making. The second component member corresponding to the second layer is a component member obtained by subjecting the natural fiber to the paper making. The synthetic fiber mixed in the first component member is a polyvinyl alcohol fiber having boron configured by polyvinyl alcohol resin having boron.

The synthetic fiber configured by the polyvinyl alcohol resin having the boron substantially has insolubility to water of about 20° C. A plane shape of the synthetic fiber is a bending shape (including a curved shape). A cross section of the synthetic fiber is formed in a substantially circular shape. By including the synthetic fiber in the tangled fiber body of the first component member corresponding to the first layer, it is possible to improve physical properties of the speaker diaphragm 1 and improve joining properties of the first layer 1A and the second layer 1B.

As ratios of the natural fiber and the synthetic fiber in the first layer 1A, the weight of the synthetic fiber may be low with respect to the weight of the natural fiber. In the first component member, mica is mixed in the natural fiber and the synthetic fiber. Consequently, the speaker diaphragm has relatively small density and is light. A Young's modulus and an internal loss of the diaphragm are relatively high. By mixing the mica in the natural fiber and the synthetic fiber of the first component member, it is possible to obtain satisfactory design properties and high productivity.

Examples of the fiber used in the speaker diaphragm 1 include a wood pulp fiber such as sulfite pulp or craft pulp, a non-wood pulp fiber such as bamboo or straw, a chemical fiber or a synthetic fiber configured by rayon, nylon, vinylon, polyester, or acrylic, an animal fiber such as silk or wool, a plant fiber such as Manila hemp or cotton, an organic fiber configured by graphite or the like, an inorganic fiber configured by silicon carbide or the like (glass fiber, carbon fiber, or ceramic fiber), and a mineral fiber configured by basalt. Examples of the natural fiber include a wood pulp fiber, a non-wood pulp fiber, a plant fiber, and an animal fiber. Examples of the tangled fiber body used in the speaker diaphragm 1 include a tangled fiber body obtained by a paper making method explained below and a tangled fiber body (e.g., non-woven fabric) obtained by a needle punch method, a water jet method, or a flash spinning method. The polyvinyl alcohol fiber (the synthetic fiber) having insolubility to water or hot water such as the polyvinyl alcohol resin having the boron may be a fiber that bonds the fiber (the natural fiber, etc.).

Figure 2:
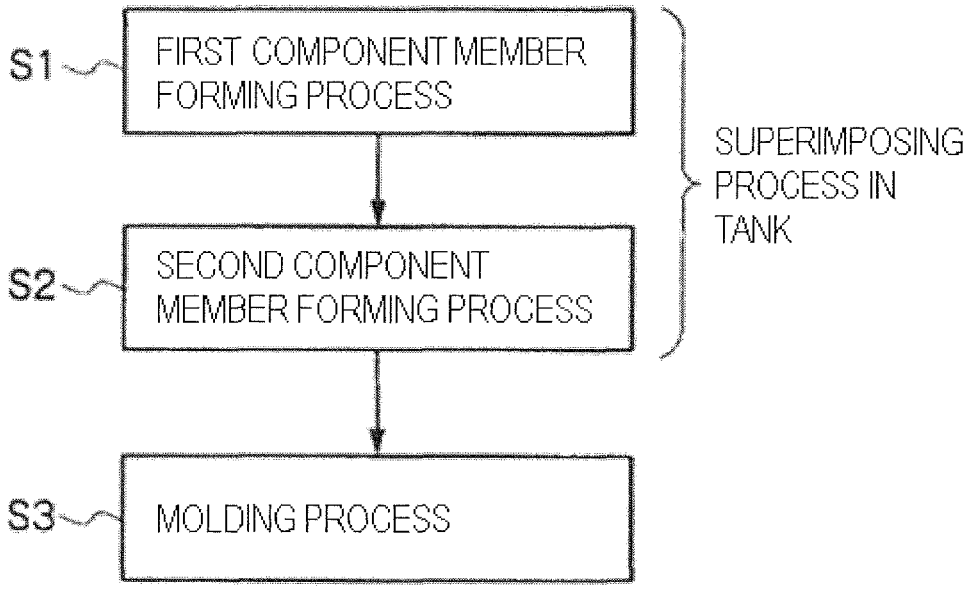
FIG. 2 is an explanatory diagram showing a production method for the speaker diaphragm according to the embodiment of the present invention.
Figure 3:
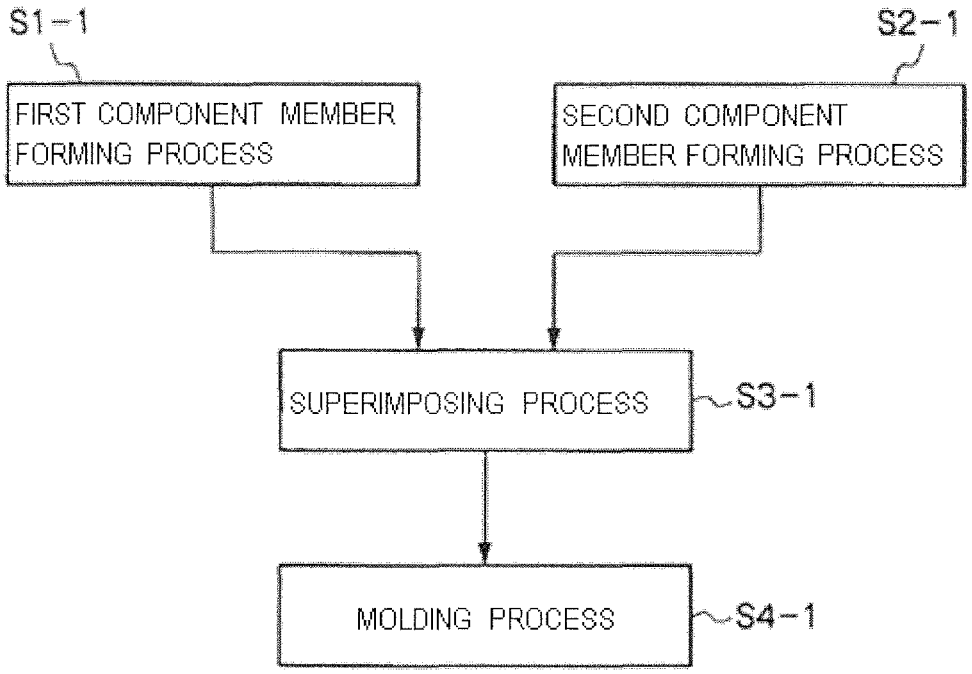
FIG. 3 is an explanatory diagram showing the production method for the speaker diaphragm according to the embodiment of the present invention.

FIG. 2 to FIG. 5 are explanatory diagrams showing a production method for the speaker diaphragm according to the embodiment of the present invention. FIG. 2 and FIG. 3 show a schematic flow of the production method. In the schematic flow shown in FIG. 2, the production method for the speaker diaphragm according to the embodiment of the present invention includes a first component member forming process S1 corresponding to the first layer 1A, a second component member forming process S2 corresponding to the second layer 1B, and a molding process S3. The first component member forming process S1 corresponding to the first layer 1A is, for example, the paper making process in which the natural fiber (the fiber) and the synthetic fiber are mixed. The second component member forming process S2 corresponding to the second layer 1B is, for example, a paper making process in which the natural fiber (the fiber) is used. In the first component member forming process S1, a mesh is arranged in one tank (for paper making) and the first component member is deposited on the mesh. In the second component member forming process S2, the mesh, on which the first component member is deposited, is moved to a different tank (for paper making). The second component member is laminated on the first component member.

Consequently, a superimposing process for the first component member and the second component member is performed in the tank. Thereafter, the two meshes and the first component member and the second component member attaching to the meshes are moved into a pair of dies. The first component member and the second component member are held between the pair of dies to heat-mold or pressure-mold the first component member and the second component member into a desired shape (the molding process S3).

In the schematic flow shown in FIG. 3, a forming process S1-1 for the first component member corresponding to the first layer 1A is, for example, a paper making process in which a natural fiber (a fiber) and the synthetic fiber are mixed. A forming process S2-1 for the second component member corresponding to the second layer 1B is, for example, a paper making process in which the natural fiber (the fiber) is used. The forming process S1-1 for the first component member and the forming process S2-1 for the second component member are performed in separate processes in which different tanks (for paper making) in parallel. In the following superimposing process S3-1, the formed first component member and the second component member are superimposed. In the following molding process S4-1, the superimposed first component member and second component member are held between the pair of dies and heat-molded or pressure-molded into a desired shape (the molding process S3-1).

Figure 4:
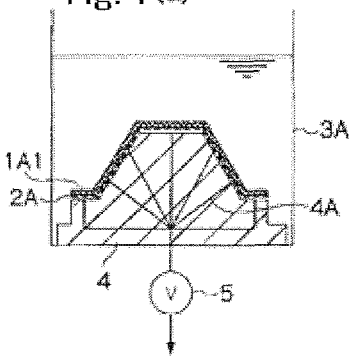
FIG. 4 is an explanatory diagram showing the production method for the speaker diaphragm according to the embodiment of the present invention.
Figure 4:
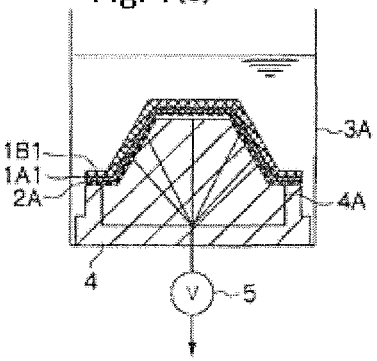
Figure 4C:
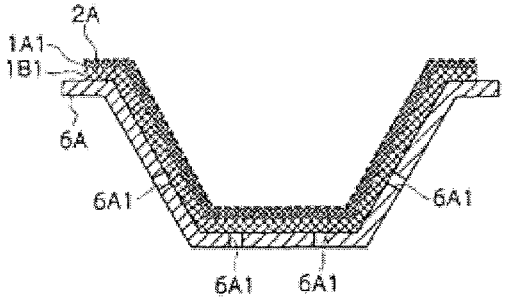
Figure 4D:
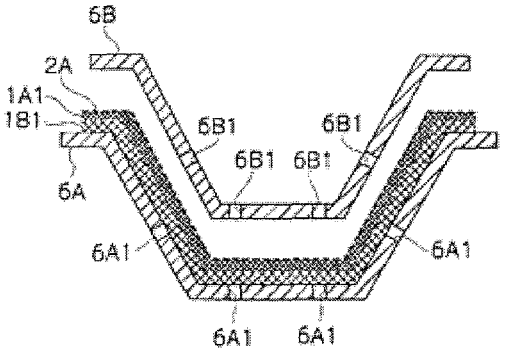
Figure 5A:
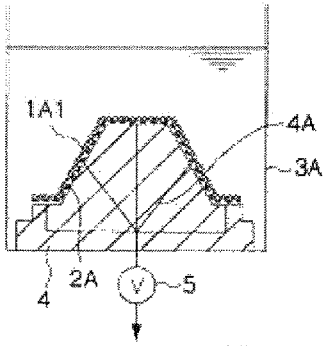
FIG. 5 is an explanatory diagram showing the production method for the speaker diaphragm according to the embodiment of the present invention.
Figure 5B:
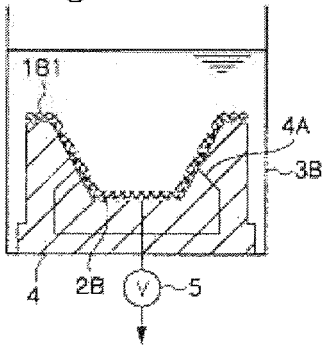
Figure 5C:
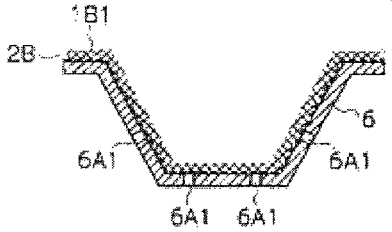
Figure 5D:
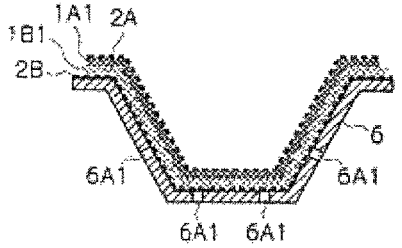
Figure 5E:
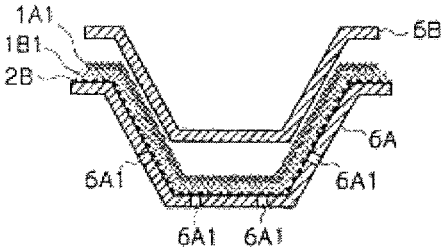

FIG. 4 is an explanatory diagram showing specific examples of the processes explained above. In the first component member forming process S1, in a state in which the outer circumference section of the mesh (the first mesh) 2A having a cone shape (a convex shape) is directed to the bottom surface section side of the tank, the mesh 2A is arranged on a stand 4 having a suction hole 4A arranged in the tank.

The suction hole 4A of the stand 4 is connected to a suction machine 5 and arranged on the mesh 2A side. Subsequently, as shown in FIG. 4(*a*), the stand 4 is lowered. The mesh 2A is immersed in a tank 3A (a first tank) filled with a suspension dispersed with the natural fiber and the synthetic fiber. Thereafter, the suspension is sucked via the suction hole 4A by the suction machine 5 present on the bottom surface section side to deposit a first component member 1A1 on the mesh 2A.

In the second component member forming process S2, as shown in FIG. 4(*b*), in a state in which the outer circumference section of the mesh (the first mesh) 2A having a cone shape, on which the first component member 1A1 is deposited, is directed to the bottom surface section side of the tank, the mesh 2A is arranged on the stand 4 having the suction hole 4A arranged in a tank 3B. As in FIG. 4(*a*), the suction hole 4A is connected to the suction machine 5. Subsequently, the stand 4 is lowered. The mesh 2A is immersed in the tank 3B (a second tank) filled with a suspension dispersed with the natural fiber. Thereafter, the suspension is sucked via the suction hole 4A by the suction machine 5 present on the bottom surface side of the tank 3B to deposit a second component member 1B1 on the first component member 1A1. Consequently, the superimposing process is performed in the tank 3B.

Subsequently, as shown in FIG. 4(*c*), the mesh 2A, on which the first component member 1A1 and the second component member 1B1 are deposited, are reversed and arranged in a first die (the lower die) 6A. That is, the bottom surface section of the mesh 2A is arranged on the first die 6A side. Subsequently, the air is sucked from a hole section 6A1 provided in the first die (the lower die) 6A. The first component member 1A1 and the second component member 1B1 are transferred from the mesh 2A into the first die (the lower die) 6A. The mesh 2A may be removed from the first die 6A or may be arranged in the first die 6A as it is.

Thereafter, in the molding process S3, as shown in FIG. 4(*d*), a second die (an upper die) 6B is placed on the first component member 1A1 and the second component member 1B1 arranged in the first die (the lower die) 6A. Subsequently, in a state in which the first component member 1A1 and the second component member 1B1 are held by the first die (the lower die) 6A and the second die (the upper die) 6B, the first component member 1A1 and the second component member 1B1 are heated or pressurized via the first die (the lower die) 6A and the second die (the upper die) 6B. After the heating or the pressurization, moisture is removed from the first component member 1A1 and the second component member 1B1. The first component member 1A1 and the second component member 1B1 are molded into a desired shape.

In this case, the first die (the lower die) 6A is arranged on the second component member 1B1 side, the second die (the upper die) 6B is arranged on the first component member 1A1 side, and the first mesh 2A is arranged between the second die (the upper die) and the first component member 1A1. The second die (the upper die) 6B has a hole section 6B1 that allows a space between the second die 6B and the first component member 1A1 and the outside to communicate with each other.

In the example shown in FIG. 4, the second die (the upper die) 6B pressurizes the first component member 1A1 via the mesh 2A. Therefore, it is possible to prevent the first component member 1A1 from closing the hole section 6B1 of the second die (the upper die) 6B. Consequently, in the molding process S3, it is possible to smoothly discharge the air from the hole section 6B1 and perform molding.

FIG. 5 is an explanatory diagram showing another specific example of the processes explained above. In the first component member forming process S1-1, as shown in FIG. 5(*a*), in a state in which the outer circumference section of the mesh (the first mesh) 2A having a cone shape (a convex shape) is directed to the bottom surface section side of the tank, the mesh 2A is placed on the stand 4 having the suction hole 4A arranged in the tank. The suction hole 4A is connected to the suction machine 5.

Subsequently, the stand 4 is lowered and the mesh 2A is immersed in the tank 3A (the first tank) filled with the suspension dispersed with the natural fiber and the synthetic fiber. Thereafter, the suspension is sucked via the suction hole by the suction machine 5 present on the bottom surface section side to deposit the first component member 1A1 on the mesh 2A.

In the second component member forming process S2-1, as shown in FIG. 5(*b*), in a state in which the outer circumference section of the mesh (the second mesh) 2B having a cone shape is directed to the bottom surface section side of the tank, the mesh 2B is arranged on the stand 4 having the suction hole 4A arranged in the tank 3B.

As in FIG. 5(*a*), the suction hole 4A is connected to the suction machine 5. Subsequently, the stand 4 is lowered and the mesh 2B is immersed in the tank 3B (the second tank) filled with the suspension dispersed with the natural fiber. Thereafter, the suspension is sucked via the suction hole 4A by the suction machine 5 present on the bottom surface section side of the tank 3B to deposit the second component member 1B1 on the mesh 2B.

In the superimposing process S3-1, as shown in FIG. 5(*c*), first, the mesh 2B, on which the second component member 1B1 is deposited, is arranged in the first die (the lower die) 6A. In this case, the mesh 2B is arranged on the first die (the lower die) 6A. Thereafter, as shown in FIG. 5(*d*), the mesh 2A, on which the first component member 1A1 is deposited, is reversed and arranged in the first die (the lower die) 6A. That is, the bottom surface section of the mesh 2A is arranged on the first die 6A side. Subsequently, the air is sucked from the hole section 6A1 provided in the first die (the lower die) 6A. The first component member 1A1 is superimposed on the second component member 1B1.

In FIG. 5(*c*), the first component member 1A1 is superimposed on the second component member 1B1 in the first die 6A. However, a superimposing method is not limited to this. For example, there is also a superimposing method explained below.

After the first component member 1A1 is deposited on the first mesh 2A and the second component member 1B1 is deposited on the second mesh 2B, the first mesh 2A is placed on the second mesh 2B arranged on the stand 4 lifted from the suspension on the tank 3B. The air is sucked via the suction hole 4A of the stand 4 in the tank 3B. The first component member 1A1 deposited on the first mesh 2A is superimposed on the second component member 1B1. The first component member 1A1 deposited on the first mesh 2A may be superimposed on the second component member 1B1 without sucking the air. In this case, the predetermined superimposed first component member 1A1 and second component member 1B1 have a predetermined moisture content. In the superimposing method explained above, the superimposition is performed on the tank 3B. However, the superimposition may be performed on the tank 3A. Note that, when the superimposing method is performed, since one of the first mesh 2A and the second mesh 2B is removed from the tank, in the molding process explained below, it is unnecessary to remove one of the first mesh 2A and the second mesh 2B from the first die 6A.

In the molding process S4 performed thereafter, as shown in FIG. 5(*d*), the mesh 2A is removed from the first die 6A. As shown in FIG. 5(*e*), the second die (the upper die) 6B is placed on the first component member 1A1 and the second component member 1B1 arranged in the first die (the lower die) 6A. The first component member 1A1 and the second component member 1B1 are heated or pressurized to remove moisture of the first component member 1A1 and the second component member 1B1. The first component member 1A1 and the second component member 1B1 are molded into a desired shape.

In this case, the first die 6A is arranged on the second component member 1B1 side. The second die 6B is arranged on the first component member 1A1 side. The second mesh 2B is arranged between the first die 6A and the second component member 1B1. The first die 6A has the hole section 6A1 that allows the space between the first die 6A and the second component member 1B1 and the outside to communicate with each other.

In the example shown in FIG. 5, the second component member 1B1 is arranged in the first die (the lower die) 6A via the mesh 2B. Therefore, it is possible to prevent the second component member 1B1 from closing the hole section 6A1 of the first die (the lower die) 6A. Consequently, it is possible to smoothly discharge vapor from the hole section 6A1 in the molding process S4 and perform molding.

Examples of the present invention are explained below. Table 1 shows the examples of the present invention and comparative examples.

TABLE 1

| | First layer (surface layer) weight ratio | | | | Second layer (rear layer) | | | | | | | |
|---|---|---|---|---|---|---|---|---|---|---|---|---|
| | Natural fiber | Synthetic fiber A | Synthetic fiber B | Mica | weight ratio/Natural fiber | Young's modulus × $10^9$ N/mm$^2$ | Internal loss | Thickness mm | Density g/cm$^3$ | Weight of diaphragm | Productivity | Design properties |
| (1) Example 1 | 50 | 10 | — | 40 | 100 | 6.5 | 0.025 | 0.34 | 0.681 | — | ○ | ○ |
| (2) Example 2 | 50 | 10 | — | 40 | Single layer | 8.4 | 0.0251 | 0.272 | 0.817 | — | ○ | ○ |
| (3) Example 3 | 50 | 60 | — | 40 | 100 | 6.0 | 0.0229 | 0.312 | 0.726 | — | ○ | ○ |
| (4) Example 4 | 50 | 60 | — | 40 | Single layer | 6.22 | 0.0278 | 0.291 | 0.772 | — | ○ | ○ |
| (5) Comparative example 1 | 60 | — | — | 40 | 100 | 3.5 | 0.0242 | 0.34 | 0.671 | Same as (1) | ○ | Δ |

TABLE 1-continued

| | First layer (surface layer) weight ratio | | | | Second layer (rear layer) | | | | | | | |
|---|---|---|---|---|---|---|---|---|---|---|---|---|
| | Natural fiber | Synthetic fiber A | Synthetic fiber B | Mica | weight ratio/Natural fiber | Young's modulus × $10^9$ N/mm$^2$ | Internal loss | Thickness mm | Density g/cm$^3$ | Weight of diaphragm | Productivity | Design properties |
| (6) Comparative example 2 | 100 | — | — | — | 100 | 4.3 | 0.0239 | 0.34 | 0.682 | Smaller than (1) | ○ | X |
| (7) Comparative example 3 | 50 | — | 10 | 40 | 100 | 4.31 | 0.0241 | 0.323 | 0.7 | Same as (1) | X | ○ |
| (8) Comparative example 4 | 50 | — | — | 40 | 100 | 5.65 | 0.0218 | 0.31 | 0.733 | Smaller than (1) | ○ | Δ |
| (9) Comparative example 5 | 50 | — | 10 | 40 | Single layer | 7.80 | 0.0238 | 0.286 | 0.775 | Same as (2) | X | ○ |
| (10) Comparative example 6 | 50 | — | — | 40 | Single layer | 5.39 | 0.0216 | 0.294 | 0.775 | Smaller than (2) | ○ | Δ |
| (11) Comparative example 7 | 60 | — | — | 40 | Single layer | 4.40 | 0.0220 | 0.313 | 0.724 | Same as (2) | ○ | Δ |
| (12) Comparative example 8 | 15 | 45 | — | 40 | 100 | 7.16 | 0.0212 | 0.34 | 0.711 | Same as (1) | ○ | ○ |
| (13) Comparative example 9 | 50 | — | 60 | 40 | 100 | 6.34 | 0.0264 | 0.312 | 0.75 | Same as (3) | X | ○ |
| (14) Comparative example 10 | 50 | — | 60 | 40 | Single layer | 5.40 | 0.0289 | 0.307 | 0.76 | Same as (4) | X | ○ |

A speaker diaphragm in an example 1 has a two-layer structure. A first layer (a surface layer) of the speaker diaphragm is configured by 50 parts by weight of a natural fiber, 10 parts by weight of a synthetic fiber A, and 40 parts by weight of mica. A second layer (a rear layer) is configured by 100 parts by weight of the natural fiber.

The synthetic fiber A is an example of a polyvinyl alcohol fiber having boron.

The example 1 indicates a higher Young's ratio, a higher internal loss, and lower density in comparison with a comparative example 1 in which a speaker diaphragm has weight substantially the same as the weight of the speaker diaphragm in the example 1 and does not include the polyvinyl alcohol fiber having the boron (the synthetic fiber A) in a first layer, a comparative example 4 in which a speaker diaphragm has weight lower than the weight of the speaker diaphragm in the example 1 and does not include the polyvinyl alcohol fiber having the boron (the synthetic fiber A) in a first layer, and a comparative example 3 in which a synthetic fiber B (polyvinyl alcohol) is used instead of the synthetic fiber A (the polyvinyl alcohol fiber having the boron) included in the first layer of the example 1.

In the example 1, since the polyvinyl alcohol fiber having the boron (the synthetic fiber A) attaches mica to a tangled fiber body, it is possible to obtain high design properties with glossiness. In the example 1, since the polyvinyl alcohol fiber having the boron substantially insoluble to high-temperature hot water is mixed, handling in the paper making process is facilitated and releasability in the molding process is high. Therefore, it is possible to improve productivity.

A speaker diaphragm in an example 2 has a single layer structure. The speaker diaphragm is configured by 50 parts by weight of the natural fiber, 10 parts by weight of the synthetic fiber A, and 40 parts by weight of the mica.

The example 2 indicates a higher Young's modulus, a higher internal loss, and a higher specific modulus of elasticity in comparison with a comparative example 7 in which a speaker diaphragm has weight substantially the same as the weight of the speaker diaphragm in the example 2 and does not include the polyvinyl alcohol fiber having the boron, a comparative example 6 in which a speaker diaphragm has weight lower than the weight of the speaker diaphragm in the example 1 and does not include the polyvinyl alcohol fiber having the boron, and a comparative example 5 in which the synthetic fiber B (polyvinyl alcohol) is used instead of the synthetic fiber A included in the speaker diaphragm of the example 2 (a specific modulus of elasticity of the example 2 is $10.28*10^9$ ($m^2/s^2$), a specific modulus of elasticity of the comparative example 7 is $6.077*10^9$ ($m^2/s^2$), a specific modulus of elasticity of the comparative example 6 is $6.955*10^9$ ($m^2/s^2$), and a specific modulus of elasticity of the comparative example 5 is $10.06*10^9$ ($m^2/s^2$)). In the example 2, as in the example 1, it is possible to obtain high design properties with glossiness and improve productivity.

A speaker diaphragm in an example 3 has a two-layer structure as in the example 1. In the speaker diaphragm, a first layer (a surface layer) is configured by 50 parts by weight of the natural fiber, 60 parts by weight of the synthetic fiber A, and 40 parts by weight of the mica and a second layer (a rear layer) is configured by 100 parts by weight of the natural fiber.

The example 3 indicates a higher Young's modulus and a higher internal loss in comparison with the comparative example 4. In the example 3, as in the example 1, it is possible to obtain high design properties with glossiness and obtain high productivity. In a comparative example 9 in which the synthetic fiber A (the polyvinyl alcohol fiber having the boron) in the example 3 is replaced with the synthetic fiber B (polyvinyl alcohol), releasability is poor and handleability in the paper making process is low. Therefore, high productivity is not obtained.

A speaker diaphragm in an example 4 has a single layer structure as in the example 2. The diaphragm is configured by 50 parts by weight of the natural fiber, 60 parts by weight of the synthetic fiber A, and 40 parts by weight of the mica.

The example 4 indicates a higher Young's modulus and a higher internal loss in comparison with the comparative example 6. In the example 4, as in the example 1, it is possible to obtain high design properties with glossiness and obtain high productivity. In a comparative example 10 in which the synthetic fiber A (the polyvinyl alcohol fiber having the boron) in the example 4 is replaced with the synthetic fiber B (polyvinyl alcohol), releasability is poor and handleability in the paper making process is low. Therefore, high productivity is not obtained.

As explained above, in the speaker diaphragm and the production method for the speaker diaphragm according to the embodiment of the present invention, the fiber and the polyvinyl alcohol fiber having the boron are mixed in the speaker diaphragm. Therefore, it is possible to obtain a high Young's modulus and a high internal loss. When the speaker diaphragm is formed in a multilayer structure, it is possible to improve, with the polyvinyl alcohol resin having the boron, a joining force or an adhesive force among layers. The polyvinyl alcohol fiber having the boron substantially insoluble to high-temperature hot water is used. Therefore, it is possible to improve handleability in the paper making process. Further, it is possible to improve releasability in the molding process. Therefore, it is possible to obtain high productivity. Further, since the mica is also mixed, the mica attaches to the polyvinyl alcohol fiber having the boron. Therefore, satisfactory glassiness is obtained. It is possible to obtain high design properties.

Figure 6:
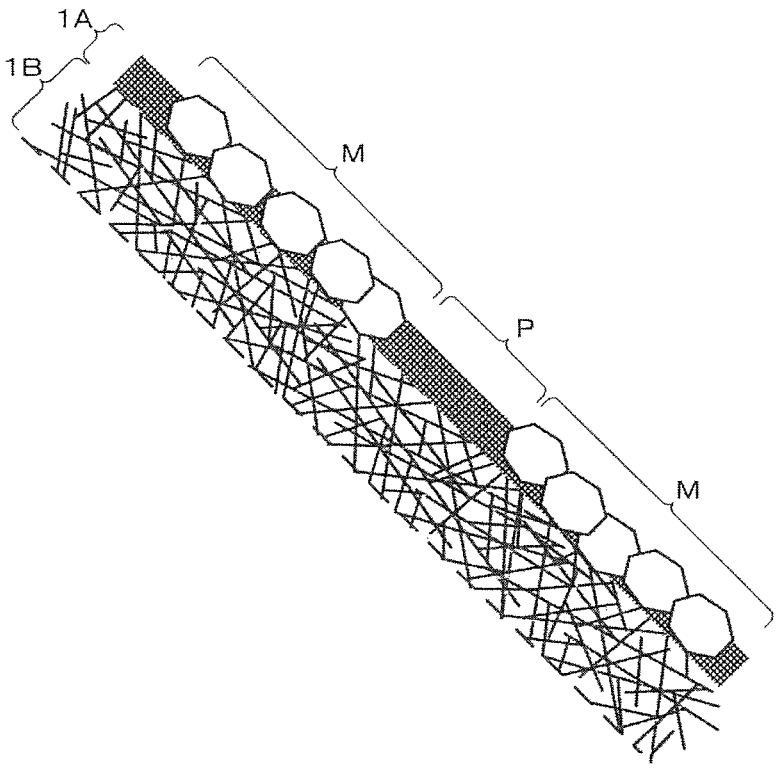
FIG. 6 is an explanatory diagram showing a structure example of the speaker diaphragm according to the embodiment of the present invention (an A part enlarged view of a cross section).
Figure 7A:
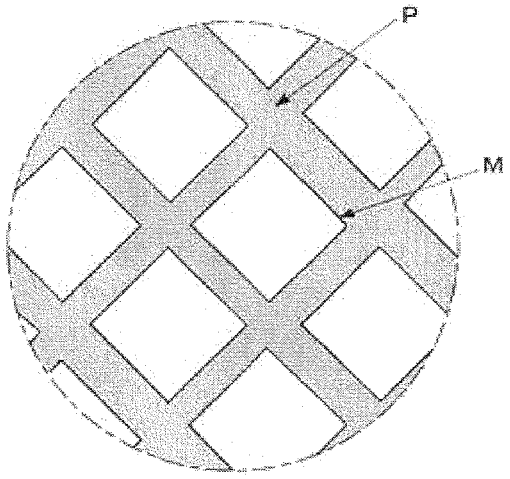
FIG. 7 is an explanatory diagram showing a structure example of the speaker diaphragm according to the embodiment of the present invention (FIG. 7(*a*) is a partial plan view and FIG. 7(*b*) shows an opening pattern of a metallic wire gauze.
Figure 7B:
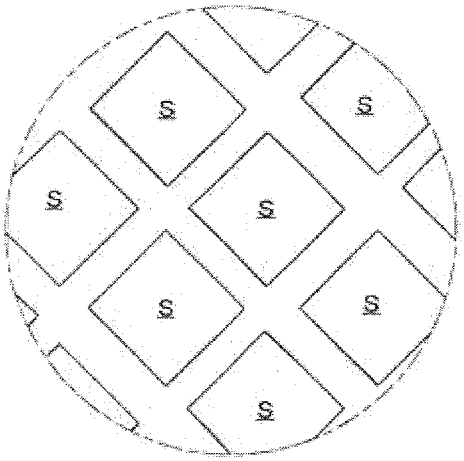
Figure 8:
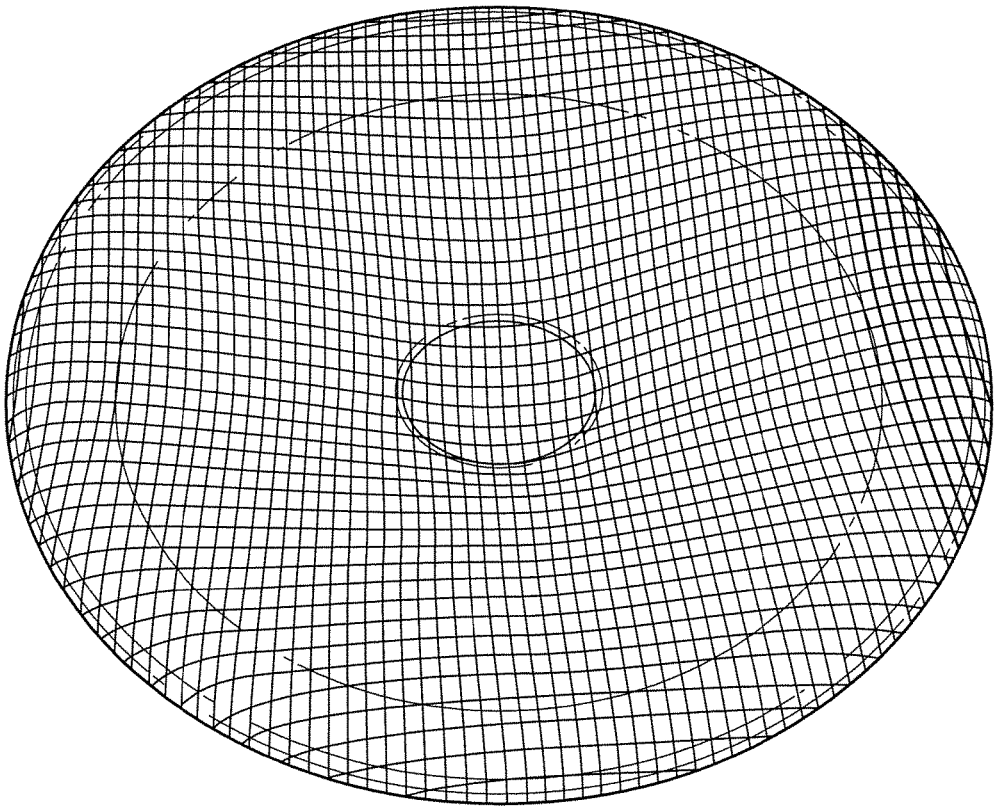
FIG. 8 is an explanatory diagram showing a structure example of the speaker diaphragm according to the embodiment of the present invention (a line drawing of a photograph showing the entire speaker diaphragm).

A structure example of the speaker diaphragm according to the embodiment of the present invention is more specifically explained with reference to FIG. 6 to FIG. 8. FIG. 6 shows an enlarged explanatory diagram of a specific configuration example of the A part in FIG. 1. FIG. 7(*a*) shows a plan explanatory view of the configuration example. In this example, the speaker diaphragm comprises the first layer 1A and the second layer 1B. In the figure, the speaker diaphragm has a two-layer structure. However, the speaker diaphragm may include the first layer 1A and the second layer 1B in a multilayer structure of three or more layers. The first layer 1A can be configured by the polyvinyl alcohol fiber having the boron. The second layer 1B can be configured by another fiber different from the polyvinyl alcohol fiber having the boron, for example, a natural fiber. The first layer 1A may be configured solely by the polyvinyl alcohol fiber having the boron or may be configured by the polyvinyl alcohol fiber having the boron and another different fiber (e.g., a natural fiber). The second layer 1B may include the polyvinyl alcohol fiber having the boron. In that case, the first layer 1A and the second layer 1B may be the same fiber.

The first layer 1A is configured by the mica and the polyvinyl alcohol fiber having the boron. The first layer 1A comprises a plurality of areas M where the mica is present. Areas P where the mica is absent are formed among the plurality of areas M where the mica is present.

When the first layer 1A including the areas M where the mica is present and the areas P where the mica is absent is formed on the surface layer, it is possible to form, with the areas M where the mica is present, desired design such as a pattern on the surface of the speaker diaphragm. FIG. 8 is a diagram (a line drawing of a photograph) showing an example of a speaker diaphragm, on the surface of which design is formed by the areas M where the mica is present. Glossy portions seen white in the figure are the areas where the mica is present.

In the first layer 1A, when a plurality of the areas M where the mica is present are provided, first, a metallic wire gauze having openings S only in areas where the mica is desired to be deposited is used to form a paper making object for configuring the first layer 1A is formed in the first tank. When the paper making object is formed, the mica and the polyvinyl alcohol fiber having the boron are deposited in the openings of the wire gauge. Subsequently, the wire gauge, on which the paper making object configuring the first layer 1A is deposited, is pulled up from the first tank and immersed in the second tank. The paper making object configuring the second layer 1B is deposited on the first layer 1A. A deposit of the deposited first layer 1A and second layer 1B is held by heated dies and dried to obtain a speaker diaphragm on which a plurality of the areas M where the mica is present are formed. Note that the production method in this embodiment is not limited to the production method explained above. The production method explained above may be changed as long as the first layer 1A and the second layer 1B can be formed. For example, a paper making object configuring the second layer 1B is formed. In parallel to the formation of the paper making object, a paper making object configuring the first layer 1A is formed using a metallic wire gauze (the metallic wire gauze having the openings S only in areas where the mica is desired to be deposited) shown in FIG. 7(*b*) corresponding to a pattern or the like. The paper making objects are stuck together. Consequently, a speaker diaphragm is obtained in which a plurality of the areas M where the mica is present are formed.

In the speaker diaphragm, the polyvinyl alcohol fiber having the boron is present in the first layer 1A. Therefore, the fiber and the mica adhere to each other. It is possible to prevent the mica from falling off the speaker diaphragm. In the areas M where the mica is present in the first layer 1A, the polyvinyl alcohol fiber having the boron is present. Therefore, it is possible to prevent other fibers such as the second layer 1B from falling off the areas M.

A surface having smoothness is formed on the first layer 1A. It is possible to suppress occurrence of fluff due to the other fibers. The polyvinyl alcohol fiber having the boron is present in the areas M in the first layer 1A. Therefore, it is possible to suppress fluff due to the other fibers in boundaries between the area P where the mica is absent and the areas M where the mica is present. It is possible to prevent the boundaries between the areas M and the areas P from becoming unclear when the other fibers cover the mica. Since the fluff of the other fibers is suppressed, it is possible to clearly distinguish the areas P where the mica is absent and the areas M where the mica is present. It is possible to represent, with high contrast, glass of the areas where the mica is present. Therefore, it is possible to improve design properties of the speaker diaphragm. Note that the surface having smoothness includes nearly smooth surfaces such as a surface on which the polyvinyl alcohol fiber melts and changes to a film state and a surface formed when the polyvinyl alcohol fiber having the boron configuring one layer or other fibers topples along the surface of the speaker diaphragm.

The surface having smoothness may be formed over the entire first layer 1A. In this case, the polyvinyl alcohol fiber having the boron covers the mica. The surface having smoothness may be formed only in the areas P where the mica is absent.

In this case, a plurality of convex sections is formed on the first layer 1A because of the presence of the mica.

The polyvinyl alcohol fiber having the boron may be deposited in the areas P to suppress fluff due to the other fibers and prevent the other fibers from covering the mica. The polyvinyl alcohol fiber having the boron may be deposited in the areas P where the mica is absent in the first layer 1A to prevent the other fibers such as the second layer 1B from falling off the areas P.

When the first layer 1A is configured by the mica, the polyvinyl alcohol fiber having the boron, and the other fibers, by adjusting a content of the mica as appropriate, it is possible to set the Young's modulus of the speaker diaphragm to a desired level. When the mica is used only in the first layer 1A, it is unnecessary to use the mica in the other layers. Therefore, it is possible to reduce the weight of the speaker diaphragm due to the use of the mica and improve sound pressure of a speaker device.

Figure 9:
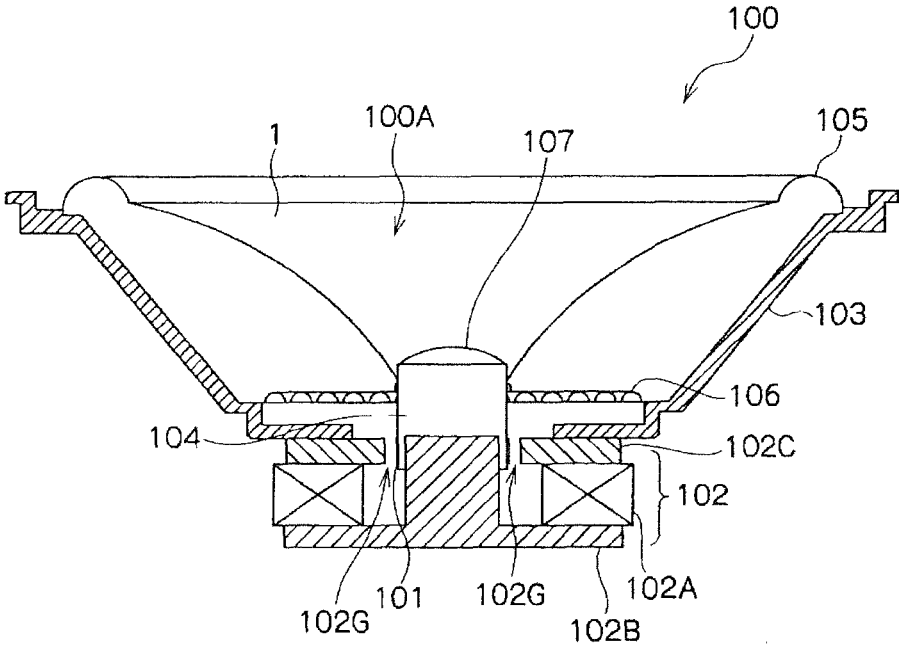
FIG. 9 is an explanatory diagram showing a speaker device comprising the speaker diaphragm according to the embodiment of the present invention.

FIG. 9 is an explanatory diagram showing a speaker device comprising the speaker diaphragm according to the embodiment of the present invention and shows a sectional structural diagram of the entire speaker device.

A speaker device 100 comprises a vibration system member 100A including the speaker diaphragm and a stationary member 100B standing still relatively to vibration of the vibration system member. The stationary member 100B supports the vibration system member 100A. The vibration system member 100A comprises the speaker diaphragm 1 and a voice coil 101 that vibrates the diaphragm 1. The stationary member 100B comprises a magnetic circuit 102 and a frame 103 to which the vibration system member 100A is attached.

In the example shown in the figure, the voice coil 101 is supported by a voice coil supporting section (a voice coil bobbin) 104. The voice coil supporting section 104 is connected to the inner circumference section of the speaker diaphragm 1. The outer circumference section of the speaker diaphragm 1 is attached to the frame 103 via a speaker edge 105. The voice coil supporting section 104 is supported slidably with respect to the frame 103 by a damper 106.

The magnetic circuit 102 is configured by a magnet 102A, a yoke 102B, and a plate 102C. A magnetic gap 102G is formed between the plate 102C and the yoke 102B. The voice coil 101 supported by the voice coil supporting section 104 is arranged in the magnetic gap 102G. The top of the voice coil supporting section 104 is covered with a center cap 107. Both ends of the voice coil 101 are connected to a terminal section, to which a sound signal is input, via a not-shown lead wire. The terminal section is electrically connected to the outside.

Examples of the magnet 102A of the magnetic circuit 102 include a rare earth magnet, a ferrite magnet, and an alnico magnet. The magnetism of the ferrite magnet or the alnico magnet having the same weight as the rare earth magnet is relatively low with respect to the magnetism of the rare earth magnet. Therefore, a driving force of the voice coil 101 is relatively small. Therefore, when the ferrite magnet or the alnico magnet is used, it is necessary to reduce the weights of vibrating bodies such as the speaker diaphragm 1, the voice coil 101, and the voice coil supporting section 104, cause the vibrating bodies to vibrate with a relatively small driving force, and provide satisfactory acoustic characteristics. Therefore, by using the speaker diaphragm 1 in this embodiment, it is possible to reduce the weights of the vibrating bodies and obtain satisfactory acoustic characteristics even with a relatively small driving force.

Figure 10A:
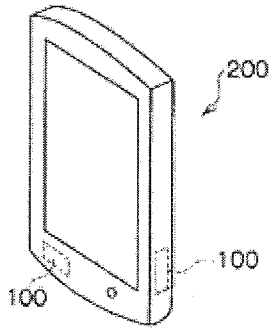
FIG. 10 is an explanatory diagram showing an electronic device, an automobile, and a building mounted with the speaker device comprising the speaker diaphragm according to the embodiment of the present invention.
Figure 10B:
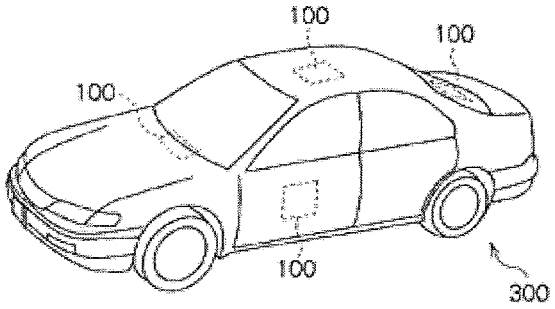
Figure 10C:
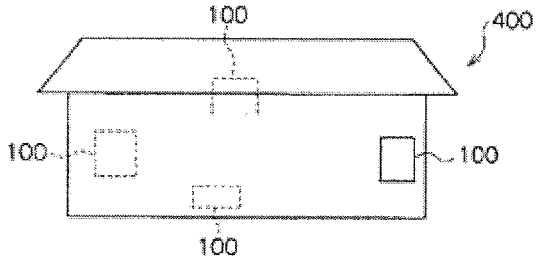

FIG. 10 is an explanatory diagram showing an electronic device, an automobile, and a building mounted with the speaker device comprising the speaker diaphragm according to the embodiment of the present invention. The speaker device 100 according to the embodiment of the present invention can be suitably mounted on an electronic device 200, an automobile 300, and a building 400 such as a house shown in the figure.

In the electronic device 200 shown in FIG. 10(*a*), the speaker device 100 can be mounted in a housing of the electronic device 200, for example, a housing of a small electronic device such as a cellular phone or a portable information terminal, a flat panel display, or an audio device. In the automobile 300 shown in FIG. 10(*b*), the speaker device 100 can be mounted on a rear part, a front part, a door part, a ceiling part, or the like of a car interior. In the building 400 shown in FIG. 10(*c*), the speaker device 100 can be mounted on an inner wall part, a ceiling part, a floor part, an outer wall part, or the like.

The embodiments of the present invention are explained in detail above with reference to the drawings. However, a specific configuration is not limited to the embodiments. A change and the like of design within a range not departing from the spirit of the present invention are also included in the present invention. The description contents of the embodiments shown in the figures can be combined as long as there is no particular contradiction or problems in the purposes, the configurations, and the like of the embodiments. The described contents of the figures could be independent embodiments. The embodiments of the present invention are not limited to one embodiment obtained by combining the figures.

What is claimed is:

1. A speaker diaphragm comprising a first layer and a second layer, wherein said first layer has mica and is configured by a first component member, which is a tangled fiber body, said tangled fiber body is configured by a natural fiber and a synthetic fiber different from said natural fiber, and said synthetic fiber is a polyvinyl alcohol fiber having boron, weight of the synthetic fiber is lower than weight of the natural fiber, and said second layer being configured by a second component member, which is a tangled fiber body.

2. The speaker diaphragm according to claim 1, wherein said synthetic fiber has a bending shape.

3. The speaker diaphragm according to claim 1, wherein said mica is attached to said synthetic fiber.

4. The speaker diaphragm according to claim 1, wherein an internal loss of said speaker diaphragm is larger than 0.0216, and a Young's modulus of said speaker diaphragm is larger than 4.40*109 N/m2.

5. The speaker diaphragm according to claim 1, wherein a cross sectional shape of said synthetic fiber is a circular shape.

6. A speaker device comprising:

the speaker diaphragm according to claim 1;

a voice coil; and a magnetic circuit having a magnet.

7. An electronic device comprising the speaker device according to claim 6.

8. An automobile comprising the speaker device according to claim 6.

* * * * *